US005299714A

United States Patent [19]

Kilgore

[11] Patent Number: 5,299,714

[45] Date of Patent: Apr. 5, 1994

[54] OIL FILTER PUNCTURING, DRAINING, AND SOCKET EXTENSION DEVICE

[76] Inventor: Gary H. Kilgore, 206 Laurel Heights Pl., San Antonio, Tex. 78212

[21] Appl. No.: 64,660

[22] Filed: May 21, 1993

[51] Int. Cl.[5] ..... B67D 5/00

[52] U.S. Cl. ..... 222/81; 222/192; 7/100; 7/142; 7/158; 7/170

[58] Field of Search ..... 222/81, 192; 7/138, 7/142, 158, 100, 170

[56] References Cited

U.S. PATENT DOCUMENTS

| | | | |
|---|---|---|---|
| 398,162 | 2/1889 | Keane | 222/81 |
| 4,177,529 | 12/1979 | Sikula, Jr. | 7/100 |
| 4,739,861 | 4/1988 | Desjardins | 7/100 X |
| 4,951,721 | 8/1990 | Moore et al. | 7/142 X |

FOREIGN PATENT DOCUMENTS

| | | | |
|---|---|---|---|
| 2136781 | 9/1984 | United Kingdom | 222/81 |

*Primary Examiner*—Gregory L. Huson

[57] ABSTRACT

The sharp end of this tool, fitted with an ordinary oil filter socket is centered against the bottom of an installed vehicular oil filter. Using an ordinary socket wrench attached to the other end of this tool, as a handle, the sharp end is pushed through the thin sheetmetal housing and interior partition of the oil filter. Once this tool has punctured the two sheetmetal surfaces, friction between: the tool and the two sheetmetal surfaces; and the ordinary oil filter socket and the exterior of the oil filter, holds the tool suspended from the oil filter. Once punctured, the oil filter drains through the hollow interior of this tool to the low end, where the flow is checked by a simple valve. To drain the oil filter and the tool, the valve is simply opened and the contents flow into a suitable container. After the flow has stopped: the valve is closed (to avoid drips); an ordinary socket wrench reattached to the tool; and the oil filter is removed in the customary fashion, less oil streaming down your arm.

1 Claim, 2 Drawing Sheets

OIL FILTER PUNCTURING, DRAINING, AND SOCKET EXTENSION DEVICE

BACKGROUND OF THE INVENTION

The Oil Filter Prick (referred to herein as "oil filter prick" and "tool") is a simple hand tool for use in the draining and removal of vehicular oil filters during oil changes. It is designed to be used in conjunction with an ordinary socket wrench and oil filter socket.

Removal of an oil filter from any vehicle is messy, but in recent years, automobile manufacturers have exacerbated the problem by locating oil filters in poorly accessible locations. The result has been an unnecessarily messy job for the person removing the filter and enviromentally undesirable oil spillage onto chassis and suspension components (and consequently, roadways); and the work area.

SUMMARY OF THE INVENTION

The Oil Filter Prick allows oil to be removed from a vehicular oil filter, prior to breaking the seal between the oil filter and its' mounting fixture. This is accomplished by attaching an ordinary oil filter socket and socket wrench to the tool. With these attached, the Oil Filter Prick is pressed through the bottom of the oil filter. Oil then drains internally, to the base of the oil filter prick to a valve which may be opened to let the oil flow into a suitable container. Thus, an oil filter in a poorly accessible location can be drained prior to removal, resulting in a much neater job.

I have designed the Oil Filter Prick to serve as a component of the ordinary socket wrench system. The Oil Filter Prick is a logical and economical solution to the annoying problem of uncontrolled oil discharge when the seal between an oil filter and its' mounting fixture is broken.

1. This tool allows oil in a vehicular oil filter to drain prior to removal of the filter from its' mounting fixture, thereby making removal of the filter less messy.
2. This tool allows oil draining from a vehicular oil filter to be controlled from the puncture point to an accessible location below the engine, where the flow can be directed into a suitable container.
3. This tool is used as an extension for an ordinary socket wrench in the removal of the vehicular oil filter, after it has drained. You would not want to withdraw the tool from the oil filter until the filter was removed, because oil would leak from the hole left by the tool.

PREFERRED EMBODIMENT

Figure 1:
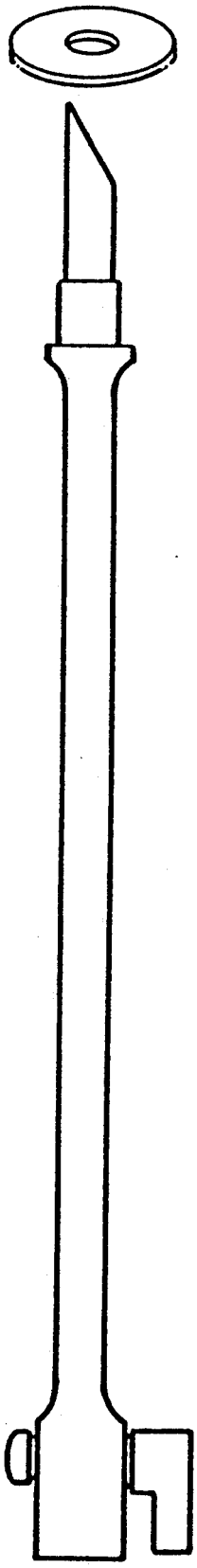
FIG. 1 illustrates an assembled Oil Filter Prick as it appears with the flow control valve in the open position. The spigot is simply turned in the opposite direction to stop the flow.
Figure 2:
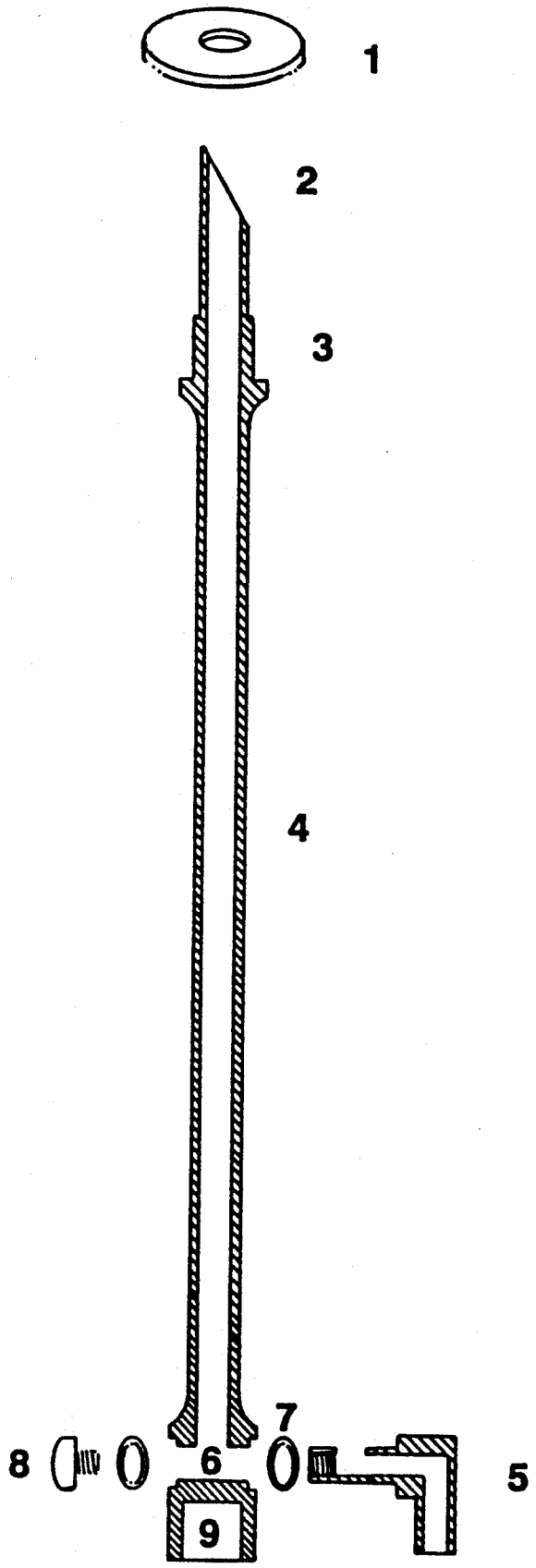
FIG. 2 illustrates an exploded Oil Filter Prick in cross-section. The resilient washer is slipped onto the punch after a oil filter socket, hence the washer is shown floating above the Oil Filter Prick in both illustrations.

An Oil Filter Prick comprises: a hollow metal shaft (4); sharpened at the filter contact end (2); a resilient washer at the base of the penetrating surface (1); a male socket wrench component (3) to seat an ordinary oil filter socket below the punch surface; a valve comprised of a spigot (5) and a valve chamber (6) at the low end of the shaft to control drainage; 2 resillient "O" rings (7) to seal the contact surfaces between the valve chamber and spigot; a screw to secure the spigot in the valve chamber (8); and a female socket wrench component (9) at the lowest end of the tool to receive an ordinary socket wrench.

I claim:

1. An oil filter puncturing and draining tool comprising in combination;

a hollow metal shaft to internally accommodate oil drainage from a vehicular oil filter and to control the flow thereform, said hollow metal shaft being sharpened at one end to penetrate said oil filters and including a resilient washer at the base of the sharpened end to form a seal with the oil filter around where it has been penetrated to minimize the leaching of oil exterior of the filter and shaft;

a male oil filter socket wrench component formed on the shaft below the washer and sharpened end to allow the oil filter to be rotated by engaging the socket with an oil filter wrench and then rotating the tool;

a valve adjacent the other end of the shaft to regulate the flow of oil through the shaft, said valve having an external hand manipulatable actuator, and;

a female socket wrench component formed in said other end of said shaft to allow the tool, oil filter socket wrench, and oil filter to be driven, and thus to remove said filter from it's engine mounting fixture.

* * * * *